US006904723B1

(12) United States Patent
Moore et al.

(10) Patent No.: US 6,904,723 B1
(45) Date of Patent: Jun. 14, 2005

(54) WATERPROOFING AND HUMIDITY CONTROL SYSTEM

(75) Inventors: Carl P. Moore, Summit County, OH (US); Nicholas D. DiCello, Summit County, OH (US)

(73) Assignee: Everdry Marketing & Management Services, Inc., Macedonia, OH (US)

( * ) Notice: Subject to any disclaimer, the term of this patent is extended or adjusted under 35 U.S.C. 154(b) by 121 days.

(21) Appl. No.: 10/347,652

(22) Filed: Jan. 21, 2003

(51) Int. Cl.[7] ..... E02D 19/00

(52) U.S. Cl. ..... 52/169.5; 52/741.13; 52/900; 454/341; 454/909; 454/38; 454/45

(58) Field of Search ..... 52/169.5, 169.14, 52/741.13, 900; 454/341, 345, 909; 405/38, 405/45, 50

(56) References Cited

U.S. PATENT DOCUMENTS

| | | | | |
|---|---|---|---|---|
| 3,173,353 A | | 3/1965 | Watkins | |
| 3,287,866 A | | 11/1966 | Bevilacqua | |
| 3,332,620 A | | 7/1967 | Streed | |
| 3,754,362 A | | 8/1973 | Daimler et al. | |
| 4,075,800 A | | 2/1978 | Molick | |
| 4,136,500 A | | 1/1979 | DiFiore | |
| 4,333,281 A | | 6/1982 | Scarfone | |
| 4,538,386 A | * | 9/1985 | DiCello | 52/302.3 |
| 4,578,912 A | * | 4/1986 | Ericsson | 52/169.5 |
| 4,949,626 A | * | 8/1990 | Townsend et al. | 454/341 |
| 4,957,394 A | * | 9/1990 | Jarnagin et al. | 405/229 |
| 5,092,520 A | | 3/1992 | Lestage | |
| 5,101,712 A | * | 4/1992 | Dean, Jr. | 454/341 |
| 5,158,501 A | * | 10/1992 | Proskiw | 454/341 |
| 5,495,696 A | * | 3/1996 | Repka | 52/169.5 |
| 5,551,497 A | * | 9/1996 | Stanley | 150/154 |
| 5,740,638 A | * | 4/1998 | Shepherd, III | 52/169.5 |
| 5,845,456 A | * | 12/1998 | Read | 52/741.11 |
| 5,870,865 A | | 2/1999 | Wesolowski et al. | |
| 6,524,182 B2 | * | 2/2003 | Kilburn et al. | 454/354 |
| 6,527,005 B2 | * | 3/2003 | Weaver | 137/312 |
| 6,634,144 B1 | * | 10/2003 | Moore et al. | 52/169.5 |

FOREIGN PATENT DOCUMENTS

| | | |
|---|---|---|
| CA | 429361 | 8/1945 |
| CA | 1097531 | 3/1981 |
| CA | 1099138 | 4/1981 |
| DE | 1186999 | 2/1965 |
| JP | 63-207933 | 8/1988 |

* cited by examiner

*Primary Examiner*—Brian E. Glessner
*Assistant Examiner*—Nahdi Amiri
(74) *Attorney, Agent, or Firm*—Fay, Sharpe, Fagan, Minnich & McKee, LLP

(57) ABSTRACT

A waterproofing and humidity control system is provided for a building which includes drain members located in trenches provided in ground beneath and adjacent the basement of the building. A suction and fan and motor assembly is located within a housing positioned within the building. Conduits communicate with the drain members and the motor and fan housing. An exhaust vent is located in the wall of the building spaced from the motor housing and has an air inlet and outlet. A separate conduit or duct communicates with and connects the inlet of the vent with an outlet of the motor and fan housing. The duct may extend between joints in the wall of the building. An adapter conduit is used with the system and is positioned between the motor and fan housing and the duct. The adapter conduit has portions which are offset from each other to allow the fan housing to be positioned in front of a finished basement wall.

26 Claims, 4 Drawing Sheets

WATERPROOFING AND HUMIDITY CONTROL SYSTEM

BACKGROUND OF THE INVENTION

The present invention relates to a system for preventing water from seeping into a building and for controlling humidity in a basement of a building, and in particular relates to a waterproofing and humidity control system for a house.

The seepage of water into a building has been a problem which constantly plagues the construction industry. This has been a problem for buildings which have basements as well as buildings built on a slab. In particular, the seepage problem has plagued buildings having a below-ground foundation wall.

It is known that the foundation wall of a building is most often made from hollow concrete blocks or poured concrete. With blocks, water is able to pass from the exterior surrounding ground of the building through cracks, holes, natural pores, etc. in the block into hollow cavities of the block and thence to the basement floor. Even if the foundation wall is made from solid blocks or poured concrete, water may seep into the basement through cracks and by capillary action.

Numerous drainage systems and methods have been developed. In one known system, drain tiles having holes therein for receiving water are located around the outside perimeter of a building, namely, around the outside perimeter of the basement floor and in a deep trench at or below the level of the footer. The drain tiles form a pipe line which directs water to a storm or sanitary sewer. After a period of time, the drain tiles become non-functioning due to collapsing, blockage, separation, etc., and water accumulates at the bottom of the foundation wall, with a resultant build-up of hydrostatic pressure. This water then seeps through cracks, holes, pores, etc. in the foundation wall and into the basement. To correct this problem, the drain tiles must be replaced.

Another system includes a trench formed along the inside of a foundation wall next to the footer and beneath the basement floor or the like. Perforated drain tiles are placed in the trench and form a pipe line which directs water to a storm or sanitary sewer. The drain tiles are surrounded by gravel. Drainage openings are provided in the bottom portion of the foundation wall beneath the basement floor. The water flows through these openings into the gravel and to the drain tiles from which the water flows into a sewer. Such a system relies on the water to drain downwardly through the concrete blocks.

Furthermore, as a result of water seepage in the basement of a building, humidity and excess moisture may occur which can cause problems such as cracking of foundations, deterioration of building materials and insulation. Other disadvantages of high humidity include the growth of mold, more noticeable odors (a musty smell) and staining when condensation occurs on walls and floors. In addition, high humidity can affect the health of the occupants of the building.

Humidity is vaporized water in air. Relative humidity is the percentage of water vapor in air at a specific temperature compared to the maximum amount of water vapor the air is capable of holding at that temperature. The construction of a house influences how much humidity is desirable. Tightly constructed buildings with properly installed vapor barriers and tight fitting doors and windows retain more heat and moisture. A mechanical ventilation system is particularly useful in this environment. If a home does not have the proper mechanical ventilation, excess water vapor can move through walls and ceilings, causing wet insulation, peeling paint, mold and structural damage.

It thus would be desirable to provide a system which minimizes the above-identified problems in the prior art and handles water buildup beneath the building, directs water and moisture away from the foundation and controls the humidity level within the basement of the building.

Accordingly, it is desirable to develop a new and improved waterproofing and humidity control system which would overcome the foregoing deficiencies and others while meeting the above-stated needs and providing better and more advantageous overall results.

SUMMARY OF THE INVENTION

The present invention relates to a new and improved waterproofing and humidity control system. More specifically, the waterproofing and humidity control system is used to minimize seepage of water and moisture into a home and reduce the level of humidity in the basement of the home.

The present invention may also be applied to different types of building structures, for example, ones having a below-ground poured concrete foundation, a below-ground concrete block foundation, or even those built on a slab. The system of the present invention is extremely effective in minimizing seepage of water into a building and lowering humidity.

More particularly according to one aspect of the present invention, a waterproofing and humidity control system for a building includes a first drain member located in a first trench provided in ground beneath a floor of the building. A suction fan and motor assembly is located within a motor and fan housing which is positioned within the building. A first conduit communicates with the first trench and the motor and fan housing. The motor and fan housing comprises a suction air inlet and an exhaust air outlet spaced from the inlet. The suction air inlet communicates with the first trench and with air within the building and the exhaust air outlet communicates with atmosphere.

According to another aspect of the present invention, a humidity control system according to the present invention includes a suction fan and motor assembly located within a motor and fan housing positioned within a building. The motor and fan housing comprises a suction air inlet communicating with the building and an exhaust air outlet communicating with atmosphere. A pair of spaced apart conduits communicate with the suction air inlet of the motor and fan housing. The pair of conduits also communicate with a trench located within a perimeter of the building. An exhaust vent housing is spaced from the motor and fan housing and is mounted to a wall of the building. The vent housing has an air inlet and an air outlet and communicates with atmosphere. A duct communicates with the motor and fan housing exhaust air outlet and the air inlet of the vent housing wherein the duct is located within the building.

According to still another aspect of the present invention, a waterproofing and humidity control system for a building comprises a first drain member located in a first trench provided in ground beneath a basement floor of the building and a suction fan and motor assembly located within a motor and fan housing that is positioned adjacent the floor of the building. A first conduit, which communicates with the trench and the motor and fan housing, can extend through the building floor. An exhaust vent is mounted to the building and spaced apart from the motor and fan housing.

The motor and fan housing suction air inlet communicates with the first conduit and with air within the building. A duct communicates with an air inlet of the exhaust vent and the exhaust air outlet of the motor and fan housing.

Still other aspects of the invention will become apparent to those skilled in the art upon reading and understanding the following detailed description.

BRIEF DESCRIPTION OF THE DRAWINGS

The invention may take form in certain components and structures, preferred embodiments of which will be illustrated in the accompanying drawings wherein.

DETAILED DESCRIPTION OF THE EMBODIMENTS

Figure 1:
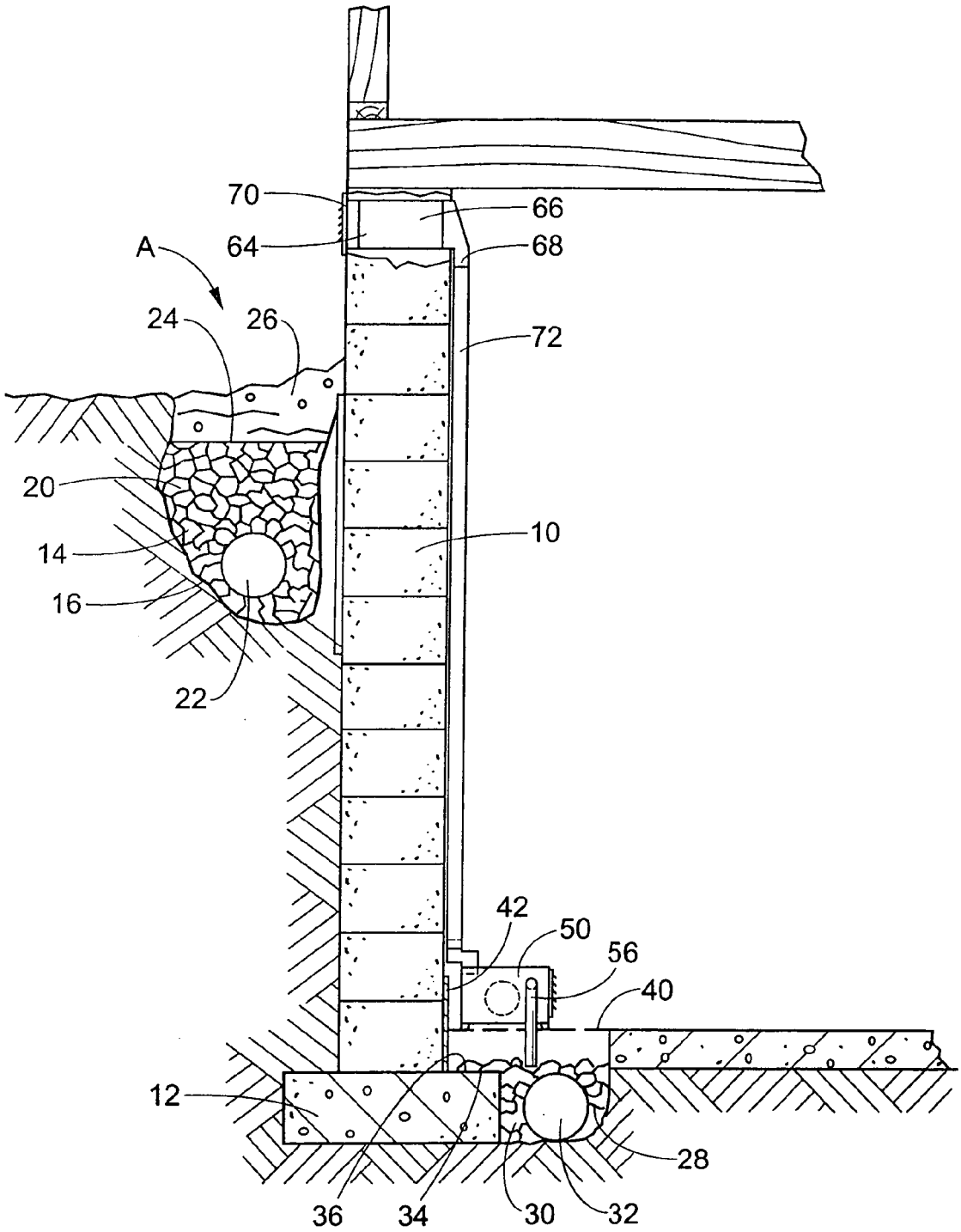
FIG. 1 is a schematic cross-sectional view of a building having a below-grade foundation wall with a waterproofing and humidity control system according to a first embodiment of the present invention applied thereto.

Referring now to the drawings, wherein the showings are for purposes of illustrating preferred embodiments of the invention only and not for purposes of limiting same, FIG. 1 shows a waterproofing and humidity control system A according to one embodiment of the present invention. This system is used with new construction buildings or homes. The waterproofing system A is used with a foundation wall 10 which is supported on a footer 12. A first, outside trench 14 is excavated to a shallow depth beneath the ground level next to the outside surface of the wall 10. Usually, the trench is not less than 18 inches deep, not less than 14 inches wide, and not greater than about three feet deep.

The trench 14 is dug at an angle to the horizontal to provide for flow of water in the tile. Thus, cumbersome deep excavation is unnecessary. The trench may be dug manually and it is unnecessary for a workman to work in a deep, narrow trench. A layer of gravel 20 is placed in the trench. The gravel is preferably a washed river bed gravel size #57.

A waterproofing sealing membrane 16 provided around the perimeter of the trench 14. The membrane 16 is preferably constructed from a minimum 4 mil visqueen or a comparable rubberized material.

A first drain tile 22 for draining water is then placed in the trench. The drain tile may take a variety of forms. For example, the drain tile may be corrugated perforated flexible pipe, plastic perforated pipe sections, etc. If pipe sections are used, the individual pipe sections or drain tiles 22 are placed in the trench and secured together by known connectors to form a pipe line.

After the drain tile 22 is placed in the trench, the trench is filled with additional gravel 20 to cover the tile. The gravel size is large enough that it does not clog the openings in the drain tile. The gravel protects the tile from dirt and allows water to flow therethrough to the tile. The gravel 20 may be covered by a perforated plastic sheet 24 which can have, for example, 18 holes per square foot, and the trench may be back filled with a backfill 26 of earth. Because of the perforated plastic sheet and gravel, dirt is not readily able to penetrate and clog the drain tile. Also, this arrangement blocks water from contact with the building base such as a slab or a foundation wall.

A second, inside trench 28 is formed adjacent an inside surface of the wall 10 next to the footer 12. Trench 28 is thus located within a perimeter of the building which is formed by wall 10 and footer 12. A gravel bed 30 (such as size #57 river gravel) is laid and drain tile 32 is placed in the inside trench 28. These tiles, if individual pipe sections, are secured together by known connectors to form a pipe line. The respective pipe lines formed by the drain tiles 22 and 32 are inclined to the horizontal to provide for free flow of water through the lines.

The drain tiles 32 are also covered with gravel 30. The gravel 30 fills the trench 28 and forms a layer on a portion 34 of a top surface 36 of the footer 12 which is located inside the foundation wall 10. The top layer of the gravel can be covered with cement forming a basement floor or base 40. This cement can be a topping cement mix specifically formulated to provide at least 7,000 psi at 2 inches in thickness.

A liner 42 is mounted between the wall 10 and the footer 12. The liner 42 extends upwardly from the top surface of the footer 12 to slightly above a top surface of the base 40.

The walls 10, especially if they are foundation walls (conventionally made from hollow blocks), may have openings or weep holes at the bottom thereof to facilitate water flow to the inside drain tiles. The water flows through the openings to the drain tiles and therefrom to a storm sewer system. The liner 42 may have notches for conducting water which flows through weep holes in the bottom of the wall 10 into the gravel. The liner may allow airflow from the blocks to aid in proper ventilation and reduce water content in the block pores. The liner may also serve as a conduit for conducting water from the openings in the wall to the inside tiles. The liner also keeps weep holes in the wall free of gravel or concrete that could block them.

The drainage system of FIG. 1 operates as follows. Surface water outside the building flows into the first trench 14, the gravel 20, and through openings in the drain tile 22. This water flows through the drain tile into a storm sewer system (not shown), to a drywell sized to properly drain the collected water, or to surface, if the surrounding grade slopes away at an acceptable rate. The tiles 22 located in the shallow trench outside the building provide for drainage of almost all surface water. Water flows into the gravel and through openings in the drain tile. Additionally, a small amount of water may build up from beneath the building base. This water flows into the drain tile 32 located beneath the base in the second trench 28. This water flows through the drain tile and is pumped by a sump pump (not shown) into the storm sewer system, or to surface, depending on conditions and local building codes. This system minimizes hydrostatic pressure underneath the concrete base 40 of the house, seals the outside surface of the wall 10, and minimizes any hydrostatic pressure that may accumulate at the outside of the base of the foundation.

Due to water seepage into the basement of the building, high humidity and excess moisture occurs which can cause problems such as cracking of the building foundation, structural damage, mold and mildew and may affect the health of the occupants of the building.

Figure 2:
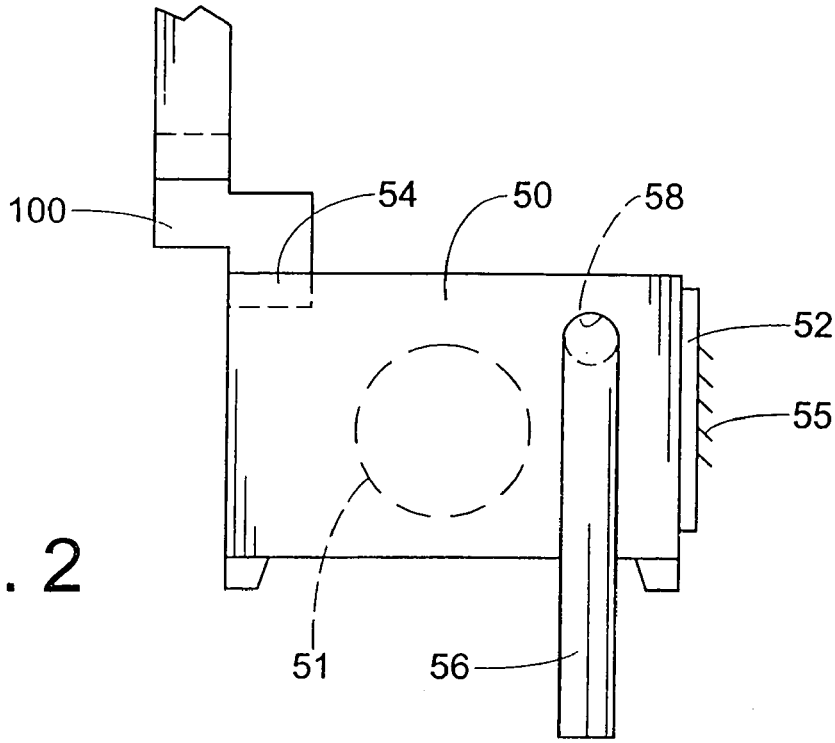
FIG. 2 is an enlarged side elevational view of a motor and fan housing of the humidity control system of FIG. 1.

Referring to FIG. 2, a humidity control system is provided to reduce the amount of humidity in the basement of the building. The humidity control system includes a motor and fan housing 50 which houses a motor and fan assembly 51. The housing is positioned in the building. As shown in FIG. 1, the housing can be positioned adjacent the basement floor 40 of the building. However, the housing may also be positioned adjacent the ceiling of the basement or in other desired locations.

The fan of the fan and motor housing can be rated at about 177 cubic feet per minute (cfm) and have a noise level of about 48 decibels (db). In other words, a very quiet fan is used so as not to disturb occupants in the building. According to another embodiment, the fan can have a variable speed in order to have an output of anywhere from 100 to 300 cfm. The speed would be controlled by a speed selector knob (not illustrated). In yet a third embodiment, the fan speed can be varied anywhere from 0 to 250 cfm. The fan speed may need to be varied depending upon the amount of square feet in the basement. It is anticipated that at around 150 to 200 cfm, the system of the present invention can handle approximately 1300 square feet of basement floor surface, that is a basement of about 35 feet by 35 feet. The cfm rating is to ensure an enhanced airflow from the basement. The fan is typically of a conventional cage and barrel design.

Referring now to FIG. 2, the motor and fan housing has a suction air inlet 52 and an exhaust air outlet 54 which is spaced from the inlet. The suction air inlet communicates with the air within the building basement and draws the air into the motor and fan housing and exhausts it from the building through the exhaust air outlet. The suction air inlet can include a plurality of louvers 55. The suction air inlet also is in communication with a conduit or hose 56 which extends into the motor and fan housing through an opening 58 in the motor and fan housing adjacent the suction air inlet. The conduit 56 communicates with the trench 28 and with the motor and fan housing suction air inlet. The opening in the fan and motor housing for the first conduit or hose can be for a ⅜ inch inner diameter hose nipple.

Figure 4:
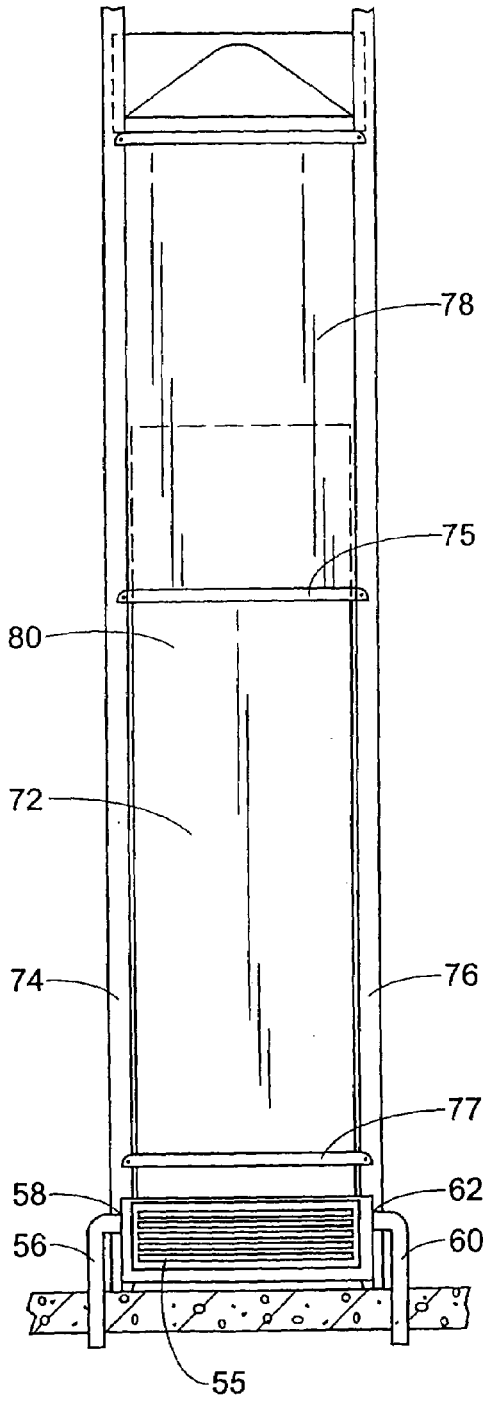
FIG. 4 is a front elevational view of a humidity control system of FIG. 1A; and, FIG. 5 is an enlarged side elevational view of a humidity control system in accordance with a third embodiment of the present invention.

A nipple can be placed on both opposite sides of the motor and fan housing and each can be on the order of about one inch long. As shown in FIG. 4, a second conduit or hose 60 may be provided on an opposite side of the motor and fan housing through a second opening 62. Each conduit or hose is attached or inserted in a corresponding nipple so that suction occurs through the two hoses.

Hoses 56 and 60 are used to control humidity in the basement by extracting humidity or moisture from the trench 28. By reducing the humidity in trench 28, the entry of humid air from the trench into the basement is minimized, thus reducing humidity in the basement, and minimizing moisture damage, odors, etc. in the basement.

With reference again to FIG. 1, the humidity system further includes an exhaust opening 64 which is located within a wall of the building spaced from the motor and fan housing. The exhaust opening can be located above the motor and fan housing. The exhaust opening further includes a housing 66 having a plurality of louvers or vents 67 on an outside surface. The housing can be formed from a suitable conventional plastic material such as polypropylene. Opposite the vents 67 of the housing 66 is inlet 68. The vents 67 can be formed in a cover 70 of the housing 66.

A third conduit 72 communicates with the air inlet of the housing 66 and the exhaust air outlet of the motor and fan housing. The third conduit 72 can be an elongated duct which extends vertically within or on a wall of the building. The duct can be formed of conventional plastic material. Alternatively, the housing 66, the duct 72 and motor and fan housing 50 can also be made of a suitable conventional metal. As seen in FIG. 4, the duct can extend between and along the longitudinal axis of two spaced apart and parallel joists 74, 76 of a finished wall. Braces 75, 77 can extend across the joists to provide lateral support. Of course if the basement room is unfinished, the third conduit can simply be located adjacent the concrete blocks of a typical basement wall.

Figure 1A:
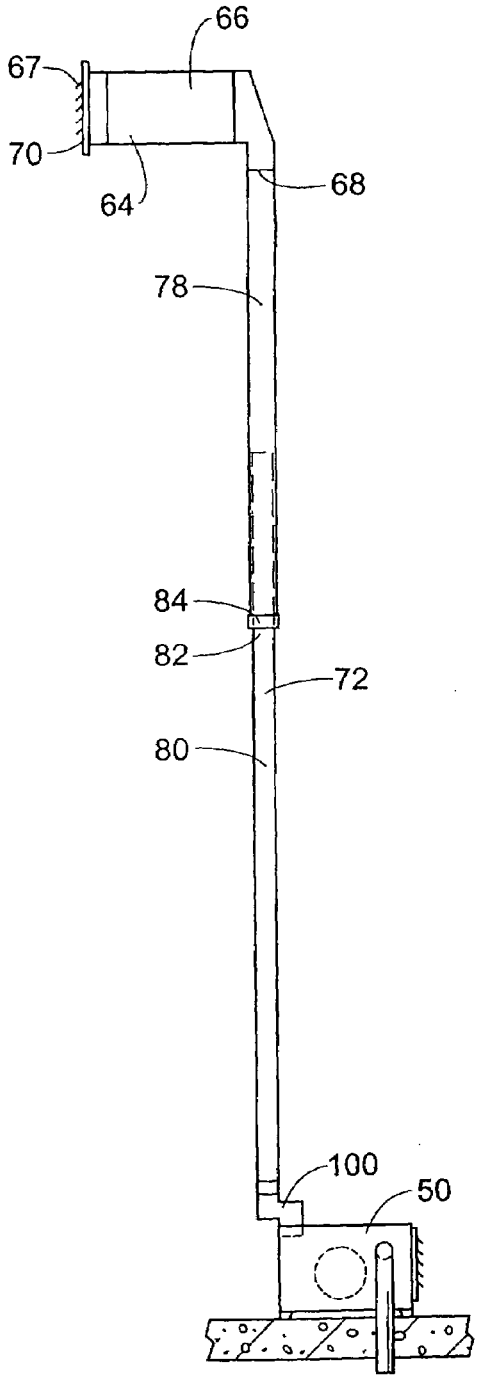
FIG. 1A is a side elevational view of the humidity control system according to another embodiment a of the present invention.

The duct is typically no more than 13.5 inches wide. The thickness of the duct typically ranges from 2½–3 inches maximum. In the second embodiment of FIGS. 1A and 4, the duct comprises a first portion 78 and second portion 80. The first portion 78 has a larger outer dimension than the outer dimension of the second portion. The second portion is thus slidably received in an opening 82 of the first portion adjacent a flange 84. The second portion 80 is thus adjustable in relation to the first portion to accommodate different basement heights. The height of the duct can range from 60 inches to about 102 inches by simply sliding the second portion with respect to the first portion.

Figure 3:
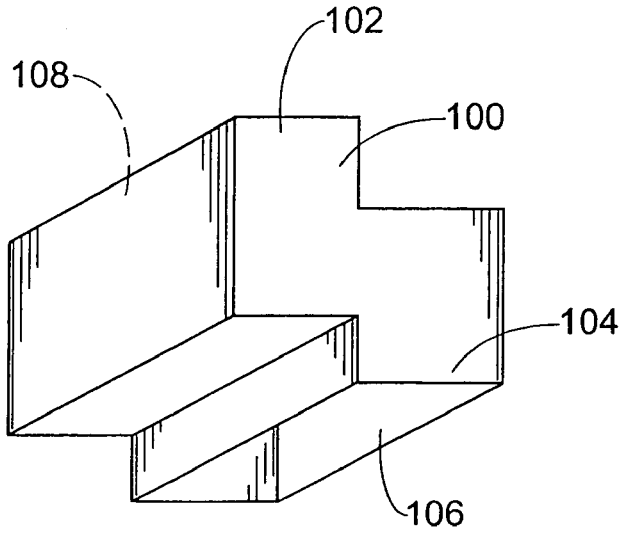
FIG. 3 is a perspective view of an adapter conduit which can be used with the humidity control system of FIG. 1.

Referring now to FIGS. 2 and 3, an adapter conduit 100 can be provided between the motor and fan housing and the third conduit or duct 72. The adapter conduit is used in a situation where the humidity control system is installed in a home with a finished basement wall. The adapter conduit has a first portion 102 and a second portion 104 wherein the first portion is offset from the second portion. The adapter conduit offset allows the front of the vertical wall duct 72 to be approximately one inch behind a back edge of the motor and fan housing exhaust air outlet 54. The adapter conduit fits on top of the fan housing and then is connected to the wall duct allowing the wall duct to be placed between the joists or studs while the motor and fan housing is positioned or sits in front of the studs. The fan housing exhaust air outlet is aligned with an opening 106 in the second portion 104 and the third conduit or duct 72 is aligned with an opening 108 of the first portion 102.

Figure 5:
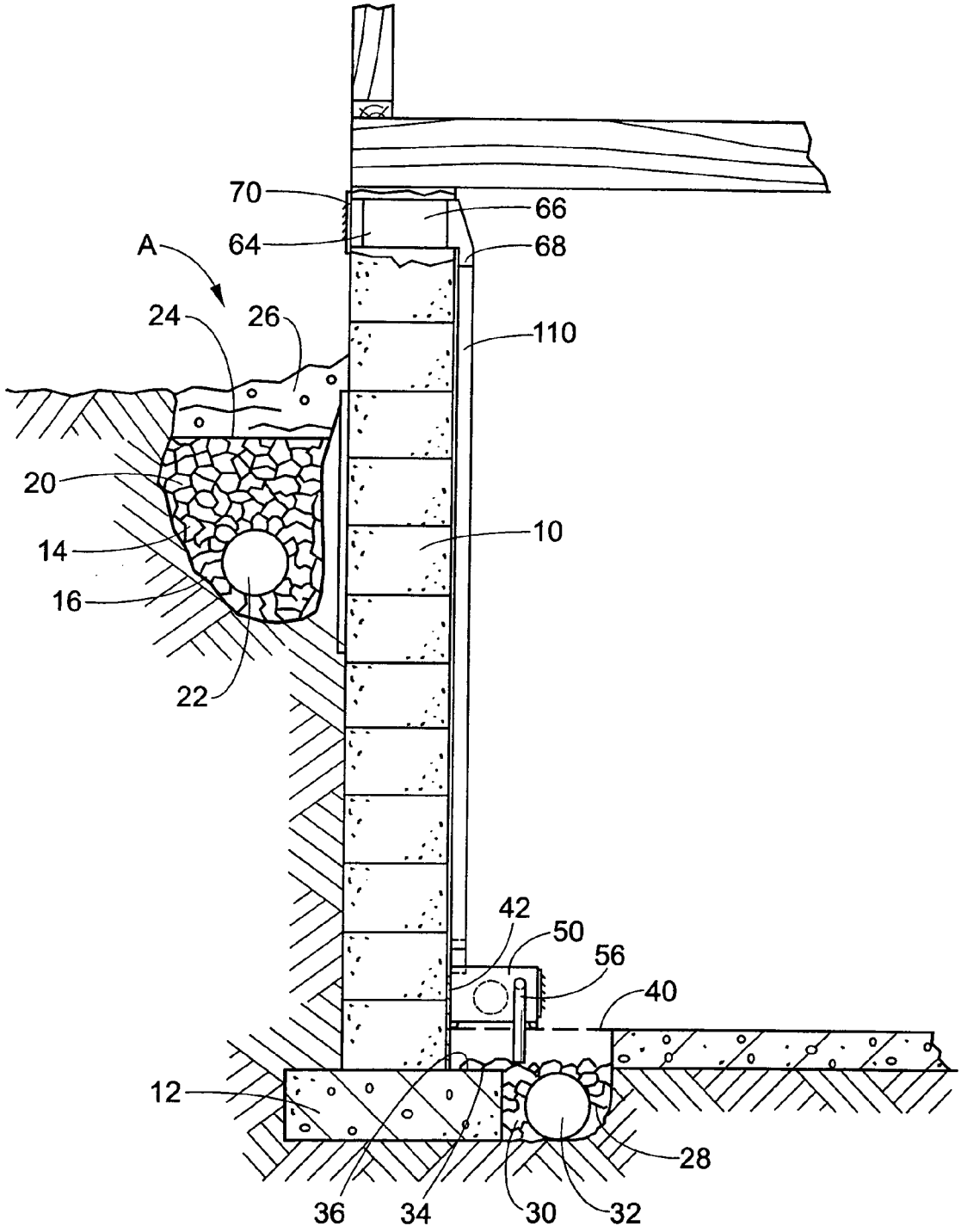

If the humidity control system is used with an unfinished wall, the adapter conduit is not needed and the duct may extend from the motor fan housing and be abutted against the wall of the basement. As shown in FIG. 5, a third embodiment of the humidity control system includes a duct 110 which extends along the longitudinal axis of the basement wall and is located adjacent the concrete blocks of the basement wall 10. The duct 110 extends from the motor fan housing 50 to the exhaust opening housing 66.

The waterproofing and humidity control system of the present invention reduces moisture in the basement, as well as the rest of the house, together with mold and mildew. This has numerous advantageous. Moisture can cause allergy problems by encouraging dust mites, dry rot and insects. It can also cause mold spores which may pose serious health risks. As is known, hazardous mold and mildew can make any space unusable. Also, the waterproofing and humidity control system of the present invention will remove, or minimize, vapors and odors from household chemicals such as cleaning supplies, paints, solvents, pesticides, volatile organic compounds, odors, formaldehyde, from pressed wood furniture, carpeting and building materials. Conventional dehumidifiers do not have such capabilities.

Moreover, the system according to the present invention will remove combustion products such as carbon monoxide, nitric oxides, unburned fuels, carbon dioxide, soot and moisture from the conventional basement furnace of a building. In addition, it can remove tobacco smoke from the building. This will prove beneficial to occupants of the building that would otherwise be exposed to second-hand smoke which, as is known, is harmful especially to children and the elderly, as well as those with chronic lung diseases or poor immune systems. Moreover, the present invention will remove heat condensation and moisture which could lead to environments that support growth of molds, mildew and wood rot.

In addition to the foregoing, the present invention is advantageous in relation to an average dehumidifier which costs normally anywhere from $10 to $30 a month to operate. In contrast, the current invention employing a suction fan and motor assembly costs on the average of about $4 a month and uses less than 50 watts of power, comparable to that of a light bulb.

The invention has been described with reference to several preferred embodiments. Obviously, alterations and modifications will occur to others upon a reading and understanding of this specification. It is intended to include all such modifications and alterations insofar as they come within the scope of the appended claims or the equivalents thereof.

Having thus described the preferred embodiments, the invention is now claimed to be:

1. A waterproofing and humidity control system for a building comprising:

a first drain member located in a first trench provided in ground beneath a floor of said building;

a suction fan and motor assembly located within a motor and fan housing;

a first conduit communicating with said first trench and said motor and fan housing;

an exhaust vent located in a wall of said building, spaced from said motor and fan housing and communicating therewith; and, said motor and fan housing comprising a suction air inlet and an exhaust air outlet spaced from said inlet, wherein said suction air inlet communicates with said first trench and with air within said building and wherein said exhaust air outlet communicates with atmosphere.

2. The waterproofing and humidity control system of claim 1, wherein said exhaust vent comprises an air inlet and an air outlet spaced from said air inlet.

3. The waterproofing and humidity control system of claim 1, further comprising a second conduit spaced from said first conduit and communicating with said first trench and said motor and fan housing.

4. The waterproofing and humidity control system of claim 3, further comprising a third conduit communicating with said air inlet of said exhaust vent and said exhaust air outlet of said motor and fan housing.

5. The waterproofing and humidity control system of claim 4, wherein said third conduit comprises a duct.

6. The system of claim 5 wherein said duct has a first section and a second section.

7. The system of claim 6 wherein said duct second section is telescopically received in said first section.

8. The system of claim 5 wherein said duct is so configured as to fit between joists of an associated wall of the building.

9. The waterproofing and humidity control system of claim 5, further comprising an adapter conduit positioned between said motor and fan housing and said third conduit.

10. The waterproofing and humidity control system of claim 9, wherein said adapter conduit has a first portion and a second portion, wherein said first portion is offset from said second portion.

11. The waterproofing and humidity control system of claim 1, wherein said motor and fan housing is positioned adjacent said floor of said building.

12. The waterproofing and humidity control system of claim 1, wherein said first trench comprises a gravel filling which covers said first drain member.

13. The waterproofing and humidity control system of claim 1, wherein said suction fan and motor housing suction air inlet comprises a plurality of vent louvers.

14. The waterproofing and humidity control system of claim 2, wherein said exhaust vent comprises a vent cover comprising a plurality of louvers in said exhaust vent air outlet.

15. A humidity control system for a building, comprising:

a suction fan and motor assembly located within a motor and fan housing positioned within said building, said motor and fan housing comprising a suction air inlet communicating with said building and an exhaust air outlet communicating with atmosphere;

a pair of spaced apart conduits communicating with said suction air inlet of said motor and fan housing, said pair of conduits also communicating with a trench located within a perimeter of said building;

an exhaust vent housing spaced from said motor and fan housing and mounted to a wall of said building, said vent housing having an air inlet and an air outlet, said vent housing communicating with atmosphere; and, a duct communicating with said motor and fan housing exhaust air outlet and said air inlet of said vent housing wherein said duct is located within said building.

16. The system of claim 15 wherein said duct has a first section and a second section.

17. The system of claim 16 wherein said duct second section is telescopically received in said first section.

18. The system of claim 15 wherein said duct is so configured as to fit between joists of an associated wall of the building.

19. The waterproofing and humidity control system of claim 15, further comprising an adapter conduit positioned between said motor and fan housing and said duct.

20. The waterproofing and humidity control system of claim 19, wherein said adapter conduit has a first portion and a second portion, wherein said first portion is offset from said second portion.

21. A waterproofing and humidity control system for a building comprising:

a first drain member located in a first trench provided in ground beneath a basement floor of said building;

a suction fan and motor assembly located within a motor and fan housing, said housing positioned adjacent said floor of said building;

a first conduit communicating with said trench and said motor and fan housing, said first conduit extending through said floor of said building;

an exhaust vent mounted to said building and spaced apart from said motor and fan housing;

said motor and fan housing comprising a suction air inlet and an exhaust air outlet spaced from said inlet, wherein said suction air inlet communicates with said first conduit and with air within said building; and, a duct communicating with an air inlet of said exhaust vent and said exhaust air outlet of said motor and fan housing.

22. The waterproofing and humidity control system of claim 21, wherein said duct is positioned within said wall of said building between two spaced apart and parallel joists.

23. The waterproofing and humidity control system of claim 21, wherein said duct comprises a first member and a second member, wherein said second member has an outer dimension less than the outer dimension of said first member and is slidably received within an opening of said first member.

24. The waterproofing and humidity control system of claim 21, further comprising an adapter conduit positioned between said motor and fan housing and said duct.

25. The waterproofing and humidity control system of claim 24, wherein said adapter conduit has a first portion and a second portion, wherein said first portion is offset from said second portion.

26. The waterproofing and humidity control system of claim 21, further comprising a second conduit spaced from said first conduit and communicating with said first trench and said motor and fan housing.

* * * * *